US006834517B1

(12) United States Patent
Sheehy, Jr.

(10) Patent No.: US 6,834,517 B1
(45) Date of Patent: Dec. 28, 2004

(54) YARN FEEDING SYSTEM

(75) Inventor: James J. Sheehy, Jr., Bensalem, PA (US)

(73) Assignee: Precision Products Co. Inc., Warminster, PA (US)

( * ) Notice: Subject to any disclaimer, the term of this patent is extended or adjusted under 35 U.S.C. 154(b) by 0 days.

(21) Appl. No.: 10/860,401

(22) Filed: Jun. 3, 2004

Related U.S. Application Data

(60) Provisional application No. 60/475,962, filed on Jun. 5, 2003.

(51) Int. Cl.[7] ..... D04B 15/38

(52) U.S. Cl. ..... 66/132 T

(58) Field of Search ..... 66/132 T, 132 R, 66/125 R, 146; 264/103; 242/365.6–365.9

(56) References Cited

U.S. PATENT DOCUMENTS 3,901,052 A * 8/1975 Jacobsson ..... 66/125 R
5,309,738 A * 5/1994 Morris ..... 66/132 T
5,520,018 A * 5/1996 Wood ..... 66/9 A

* cited by examiner

*Primary Examiner*—Danny Worrell

(74) *Attorney, Agent, or Firm*—Armand M. Vozzo, Jr.

(57) ABSTRACT

An improved system and associated method is disclosed for positive feeding of multiple strands of yarn from spools using a single motor drive within a hose reinforcement knitting machine of the type having a central knitter head with reciprocating needles that stitch a reinforcement web pattern around flexible hose moving through the central axis of the machine. The positive yarn feeding system comprises a feeder head assembly attached to rotating framework of the knitting machine coaxially with the knitter head. The feeder head assembly includes a circular support plate having an axial opening therethrough and a plurality of positive feeder units, one for each of the yarn strands intended for knitting. The feeder units are arranged in a radial pattern about the periphery of the support plate and interconnected for concurrent rotation by a coupling belt extended about upper wheels on the units. The feeder head assembly further includes a central gear mounted in a stationary position atop the support plate, a planetary gear rotatably mounted upon the support plate in position to engage the central gear, an adjustable control gear secured atop the planetary gear, and a drive belt engaged about the control gear and a proximate one of the feeder units to provide the rotational drive for all. As the single motor drive rotates the framework of the knitter machine and its mounted spools, the feeder head assembly rotates in unison and by means of the combined arrangement of interconnected gears assembled thereto, synchronizes the drawing of the yarn strands through the feeder units and into the central knitter head.

12 Claims, 5 Drawing Sheets

YARN FEEDING SYSTEM

CROSS-REFERENCE TO RELATED APPLICATION

This application is a continuation-in-part of Provisional Application Ser. No. 60/475,962 filed Jun. 5, 2003 for Yarn Feeding System.

BACKGROUND OF THE INVENTION

The present invention relates generally to the production of reinforced flexible hose having a knitted pattern of yarn or other fabric material secured upon the exterior hose surface, and more particularly to an improved system and associated method for the positive feeding of the yarn in multiple strands around the hose at a controlled and synchronized rate using a single motor drive and novel feeder head assembly that enhances the product quality and efficiency of production of the reinforced hose.

Flexible hose made of rubber, synthetic plastics, and the like have limited burst strength so that their use in industry for the transmission of fluids at high pressure require a reinforcement of their exterior surface. A longstanding and well known method for reinforcing such flexible hose uses a circular knitting machine that applies the yarn or like fabric material in a mesh like pattern around and along the exterior of the hose as it is drawn through the knitting machine. A common type of circular knitting machine generally adapted for use in hose reinforcement comprises a hollow cylindrical member, called a knitter head, containing a plurality of latch needles that are symmetrically arranged about the knitter head and made to reciprocate within equally spaced guide slots axially formed along the head, the reciprocating action of the needles being imparted typically by one or more cam members that are mounted for rotation along with the knitter head. Individual strands of yarn, usually drawn from separate cones or spools mounted on the knitter machine, are directed in a path to each latch needle in the knitter head so that the reciprocating needle will engage the strand in the one direction and pull the yarn through the knitter head and onto the hose exterior in the opposite direction as the hose travels therethrough. This process is repeated with all the reciprocating needles acting together around the knitter head to produce a stitched pattern of the knitted yarn surrounding the hose that can be varied in size and disposition of the stitches to provide it with the required reinforcement strength.

In the past, such circular knitting machines would rely on the tension adjustment of the yarn as it was drawn through the knitter head, typically using a spring-loaded washer device, to regulate the flow rates of the yarn strands and thereby control the stitching pattern of the reinforcement. This process of tension adjustment, however, was often inconsistent and generally proved unreliable, with resulting variations in yarn tension that caused uneven patterns of reinforcement along the hose product, the uneven removal of yarn from the individual spools, and a damaging stress on the knitting needles that would in turn result in needle failure and machine breakdown. Supplemental positive feeding devices, such as that described in U.S. Pat. No. 5,309,738, have been devised to overcome the problems of strand tensioning and the detrimental effects that result when knitter needles alone are used to draw the yarn strands from their respective supply packages and through the knitter head. These and other positive yarn feeding devices have been satisfactory and effective in equalizing the feed rates of the individual yarn strands onto the knitter head and in coordinating those feed rates with the rate at which the knitter head with its reciprocating needles acts upon the respective strands to knit the desired reinforcement pattern about the hose. Although existing positive yarn feeding devices have been effective in their operational performance, they have generally required the use of multiple drive motors with associated mechanical and electrical means to maintain them in unison so that the final reinforced hose product is made to the desired specifications. Thus, while generally found to be effective, the multi-drive positive feeding systems of the prior art have been relatively expensive to assemble and run and, because of the essential coordination required between the separate drives, they are inherently at risk to a possible system failure or disorientation between drives that can result in costly downtime of the hose reinforcement system as well as the production of defective quantities of hose product having inadequate or improper reinforcement. A need therefore exists for an improved system and associated method for positive yarn feeding to be incorporated within a circular knitting machine used to produce reinforced flexible hose.

SUMMARY OF THE INVENTION

Accordingly, it is a general purpose and object of the present invention to provide an improved positive yarn feeding device and associated method for use in the production of reinforced flexible hose.

A more particular object of the present invention is to provide a positive yarn feeding system that delivers multiple strands of yarn to the knitter head of a conventional circular knitting machine at a controlled and synchronized rate and in a manner more economical and efficient than heretofore devised.

Another object of the present invention is to provide an improved positive yarn feeding system for use in the production of reinforced flexible hose that is reliable in its operation so as to reduce downtimes and defects in the production process.

Still another object of the present invention is to provide an improved positive yarn feeding system for knitted reinforcement of flexible hose that enhances the quality of the reinforced hose product and affords greater control of the knitted pattern applied during production.

A still further object of the present invention is to provide a positive yarn feeding system that is easily assembled and readily adapted to the knitter heads of conventional circular knitting machines used for flexible hose reinforcement.

Briefly, these and other objects of the present invention are accomplished by an improved system and associated method for the positive feeding of multiple strands of yarn from spools using a single motor drive within a hose reinforcement knitting machine of the type having a central knitter head with reciprocating needles that stitch a reinforcement web pattern around flexible hose moving through the central axis of the machine. The positive yarn feeding system comprises a feeder head assembly attached to rotating framework of the knitting machine coaxially with the knitter head. The feeder head assembly includes a circular support plate having an axial opening and a plurality of positive feeder units, one for each of the yarn strands intended for knitting. The feeder units are arranged in a radial pattern about the periphery of the support plate and interconnected for concurrent rotation by a coupling belt extended about upper wheels on the units. The feeder head assembly further includes a central gear mounted in a stationary position atop the support plate, a planetary gear rotatably mounted upon the support plate in position to engage the central gear, an adjustable control gear secured atop the planetary gear, and a drive belt engaged about the control gear and a proximate one of the feeder units to provide the rotational drive for all. As the single motor drive rotates the framework of the knitter machine and its mounted spools, the feeder head assembly rotates in unison and by means of the combined arrangement of interconnected gears assembled thereto, synchronizes the drawing of the yarn strands through the feeder units and into the central knitter head.

For a better understanding of these and other aspects of the present invention, reference should be made to the following detailed description taken in conjunction with the accompanying drawings in which like reference numerals and characters designate like parts throughout the figures thereof.

BRIEF DESCRIPTION OF THE DRAWINGS

For a fuller understanding of the nature and object of the present invention, references in the detailed description of the preferred embodiment set forth below shall be made to the accompanying drawings in which.

DETAILED DESCRIPTION OF THE INVENTION

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to appended claims.

Figure 1:
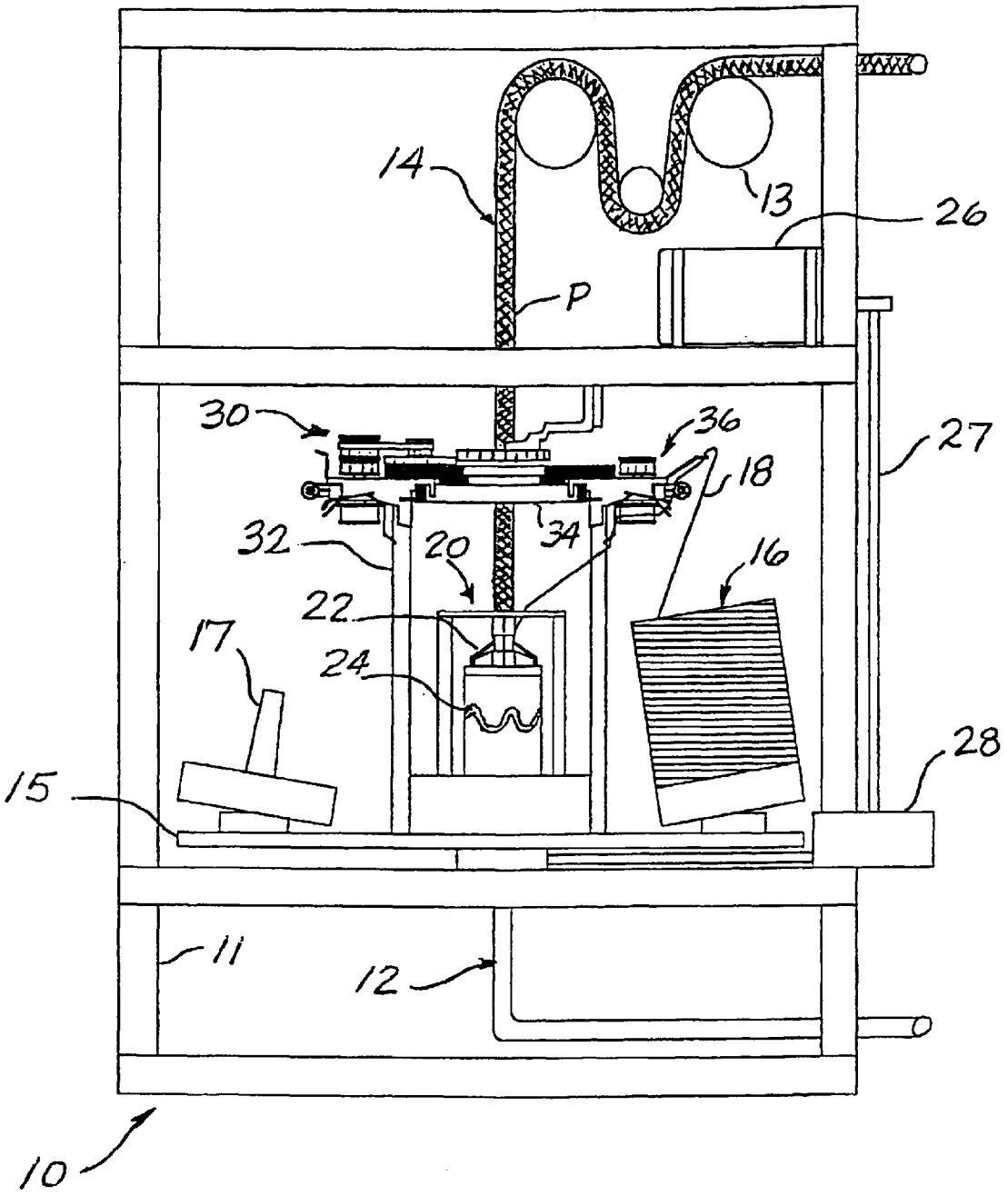
FIG. 1 is a vertical elevation of a circular knitting machine used for hose reinforcement and equipped with a yarn feeding system made in accordance with the present invention.

Referring now to FIG. 1, a circular knitting machine, adapted for hose reinforcement and generally designated 10, is vertically oriented and disposed about a central axis through which a flexible hose 12 is drawn upward at a controlled rate for application of a knitted yarn pattern P around the exterior surface and along the length of the hose. The hose 12 is drawn from a stored supply (not shown) apart from the knitting machine 10 and routed typically through a base section 11 of the machine. Upon application of the knitted yarn pattern P, the resultant reinforced hose 14 is further drawn and routed through an upper portion of the knitter machine 10, typically through an arrangement of pulleys 13, for delivery to a remote station for further processing.

The middle portion of the knitting machine 10, contains a rotatable deck 15 upon which a plurality of yarn spools 16 or like supply packages are supported in a radial arrangement relative to the central axis of the machine. A mounting support member 17 secured to the deck 15 at the corresponding radial positions of the yarn spools 16 is used to engage the core of the spools, holding each spool substantially upright and maintaining them in proper position during rotation of the deck. Individual yarn strands 18 are drawn from the top of each spool 16 during rotation of the deck 15 and, as described in greater detail below, positively fed in accordance with the present invention to a knitter head 20 of conventional design disposed along the central axis of knitting machine 10.

Knitter head 20 is a cylindrical device generally well known in the prior art that contains a plurality of knitting needles 22 radially separated and guided for reciprocating action along the cylindrical axis of the knitter head, the needles being moved in such fashion by a multi-lobe cam ring 24 coupled to the needles. As the cam ring 24 is rotated, the reciprocating action is imparted to the respective knitting needles in succession so that as the needles are delivered yarn, they apply the knitted yarn pattern P in a circular manner upon the exterior of the hose 12 as it passes through the knitter head 20. Reference in this regard to the structure and operation of such a knitter head 20 may be made to U.S. Pat. Nos. 3,462,976 and 5,520,018 and the patents cited therein.

In accordance with the yarn feeding system of the present invention, a feeder head assembly 30 is erected about and coaxially disposed above the knitter head 20. A plurality of frame posts 32, preferably four in number arranged in a square configuration, are set about the knitter head 20 and connected at their respective base ends to the deck 15 to permit concurrent coaxial rotation of the frame posts with the deck. At the top of the frame posts 32 and across their respective ends, the feeder head assembly 30 is attached so that it may rotate about the knitter head 20 substantially in its entirety and in unison with the deck 15. A single drive motor 26 is mounted within the knitter machine 10 and operatively coupled to the deck 15 via a drive shaft 27 and associated gear box 28 to rotate both the deck with its yarn spools 16 thereon and the feeder head assembly 30 upon frame posts 32 coaxially about the knitter head 20 and the central axis of the knitter machine 10.

Figure 2:
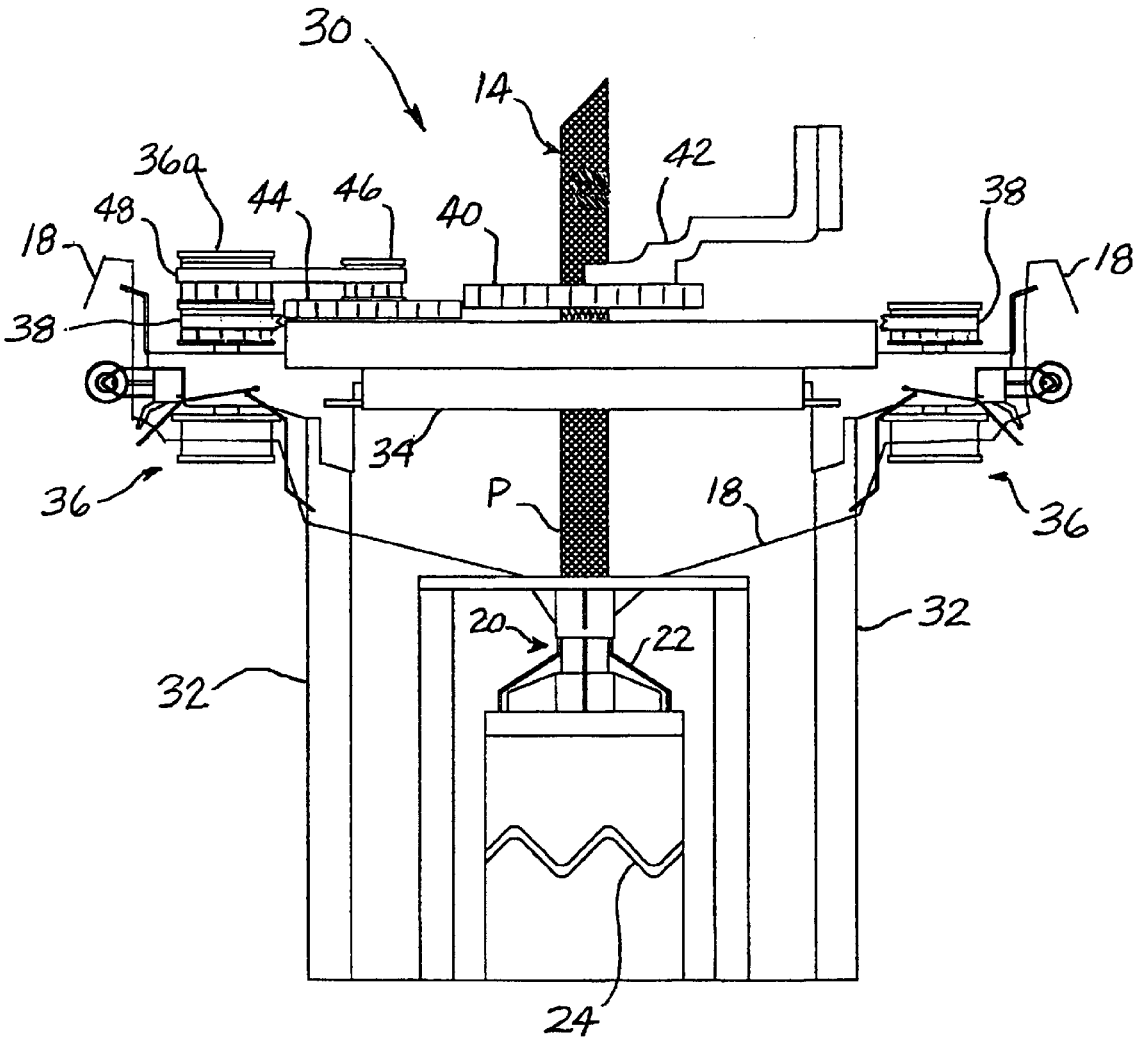
FIG. 2 is a partial elevation of the knitting machine of FIG. 1 with an enlarged view of the yarn feeding system of the present invention.

Referring now to FIG. 2 in conjunction with FIG. 1, the feeder head assembly 30 includes a circular support plate 34 having an annular opening centrally therethrough to permit passage of the reinforced hose 14 upon upwardly exiting the knitter head 20. Support plate 34 is mounted directly upon frame posts 32 and is secured thereto by conventional means of attachment. A plurality of yarn feeder units 36, one for each of the corresponding number of yarn spools 16, are mounted to the support plate 34 about the periphery thereof in separate radial positions that are equally spaced apart, as better seen in FIGS. 3 and 4. The yarn feeder units 36 employed in the feeder head assembly 30 are those characterized in the industry as "positive feeders" that incorporate yarn tensioning controls that even the tension of the yarn fed through the unit regardless of the feed rate. A yarn feeder unit 36 suitable in structure and operational features for use in the yarn feeder assembly 30 is Model MPF-K1 currently manufactured by MEMMINGER-IRO GMBH of Dornstetten, Germany. All of the yarn feeder units 36 disposed about the periphery of the support plate 34 are interconnected for rotation in unison by a toothed belt 38 that stretches about and engages respective wheel drives 36*a* on each of the feeder units.

The feeder head assembly 30 further includes a central gear 40 stationed just atop the support plate 34 in a coaxial position relative thereto, a center opening in the gear being maintained in axial alignment with the annular opening in the support plate to permit and ensure passage of the reinforced hose product 14. The central gear 40 is mounted and maintained in stationary position above the support plate 34 by means of a bracket member 42 that is attached to the upper frame of the knitter machine 10. A planetary gear 44 is rotatably mounted to the top of the support plate 34 and positioned thereon so that it engages the perimeter teeth of the stationary central gear 40 as the support plate is made to rotate. A separate control gear 46 generally having a reduced diameter, which may be altered in its size and number of its teeth, is coaxially positioned upon the planetary gear 44 and releasably secured thereto. When secured in place, the control gear 46 is made to rotate coaxially together with the planetary gear 44 about the central gear 40 but at a rotational rate generally faster than the planetary gear due to its reduced diameter. A drive belt 48, preferably toothed in its form, is engaged about the control gear 46 and a proximate one of the yarn feeder units 36 upon an extended upper wheel 36*a* provided thereon in order to transmit rotational motion from the planetary gear 44, at an adjustable rate, to all of the yarn feeder units 36. The adjustable rate of rotation transmitted to the yarn feeder units 36 is controlled and determined by the relative size and number of teeth of the control gear 46. It should be noted and understood that by changing the size and number of teeth of the control gear 46, the rate and amount of yarn fed into the knitter head 20 by the present yarn feeding system can be varied so that with a predetermined number of knitting needles 22 reciprocating within the knitter head and a known exterior diameter and feed rate of the flexible hose 12 being processed, the quality measure of the knitted yarn pattern P applied to the hose, typically specified in courses-per-inch (CPI), can be controlled with considerable precision.

Figure 3:
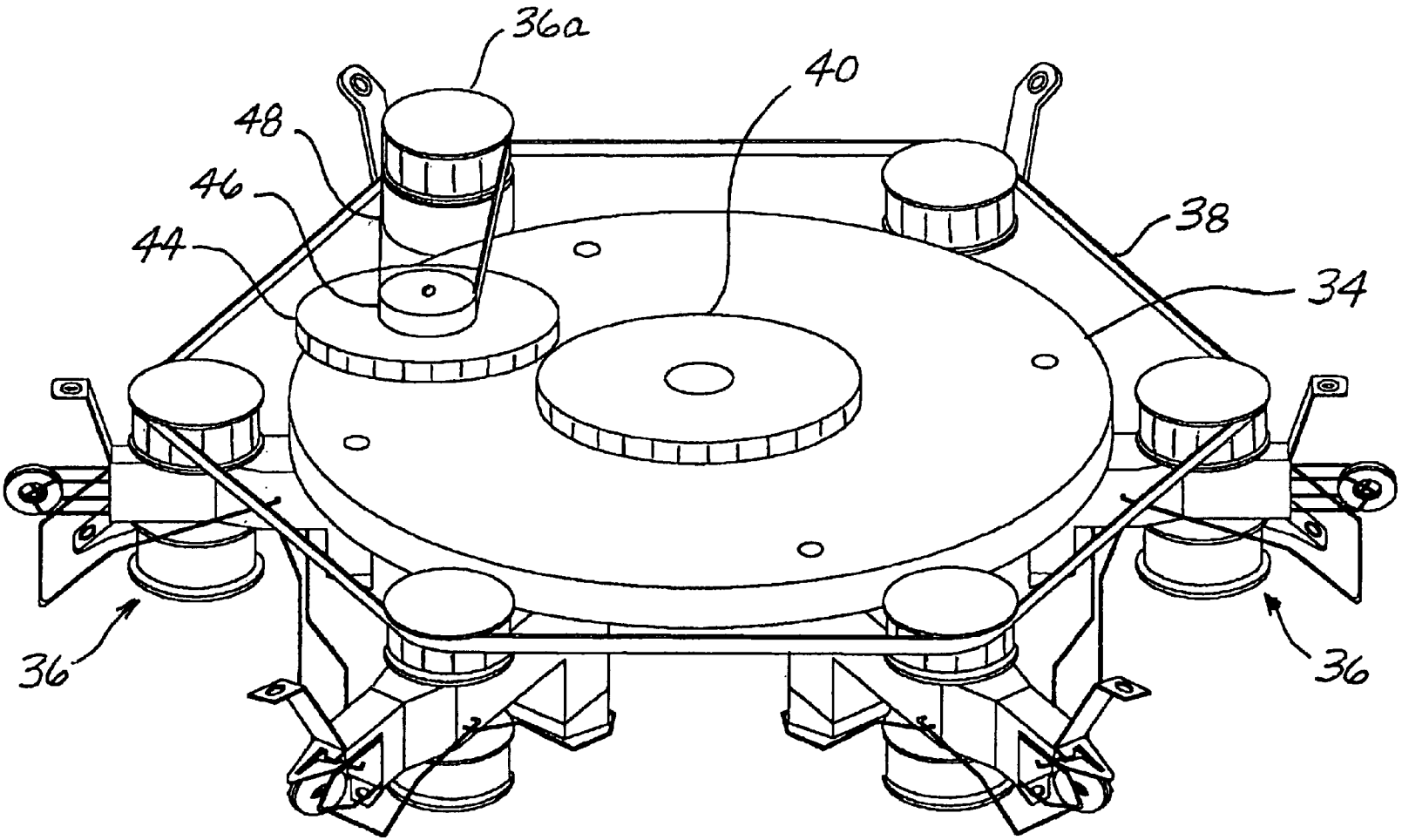
FIG. 3 is an isometric from the top of the yarn feeding system shown in FIG. 2.
Figure 4:
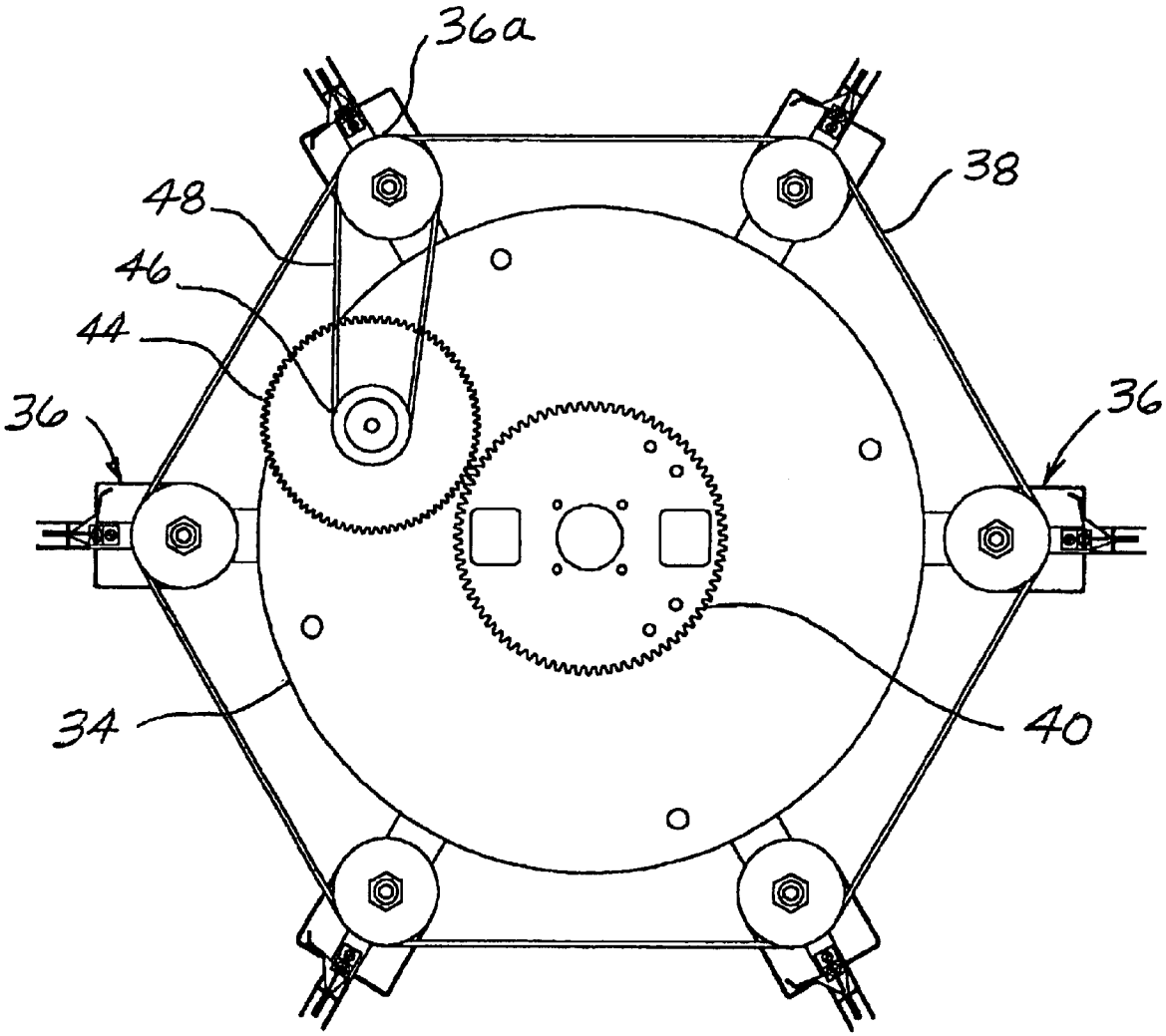
FIG. 4 is a top plan view of the yarn feeding system shown in FIG. 3.

Referring now to FIGS. 3 and 4 in conjunction with FIGS. 1 and 2, the feeder head assembly 30 of the present yarn feeding system combines the plurality of yarn feeder units 36 in radial arrangement about the rotatable support plate 34 and, utilizing the single rotational drive of motor unit 26, serves to provide synchronized rate control of the positive feeding of yarn strands 18 through the feeder units and into the knitter head 20. By means of the rotational engagement and cooperation of stationary central gear 40, planetary gear 44 and its associated control gear 46, all linked to the yarn feeder units 36 via drive belt 38, a controlled and even flow of yarn strands is positively fed into the chamber of the knitting head with reduced stress on the reciprocating needles. The feeder units 36 are coupled together via belt 38 and driven in unison by the rotating action of the planetary gear 44 as it spins with and upon the support plate 24 about the central gear 40. Adjustment of the rate of the feeder units 36 is effected by changing the size and number of radial teeth of the control gear 46 and provides the improved capability of controlling the CPI of the knitted yarn pattern P applied to the hose 12 drawn through the knitting machine 10. By this adjustable rate control feature, the present yarn feeding system simplifies and ensures compliance with the required strength specifications placed upon the reinforced hose and while maintaining a positive and even flow of yarn strands 18 to the knitter head 20.

Figure 5:
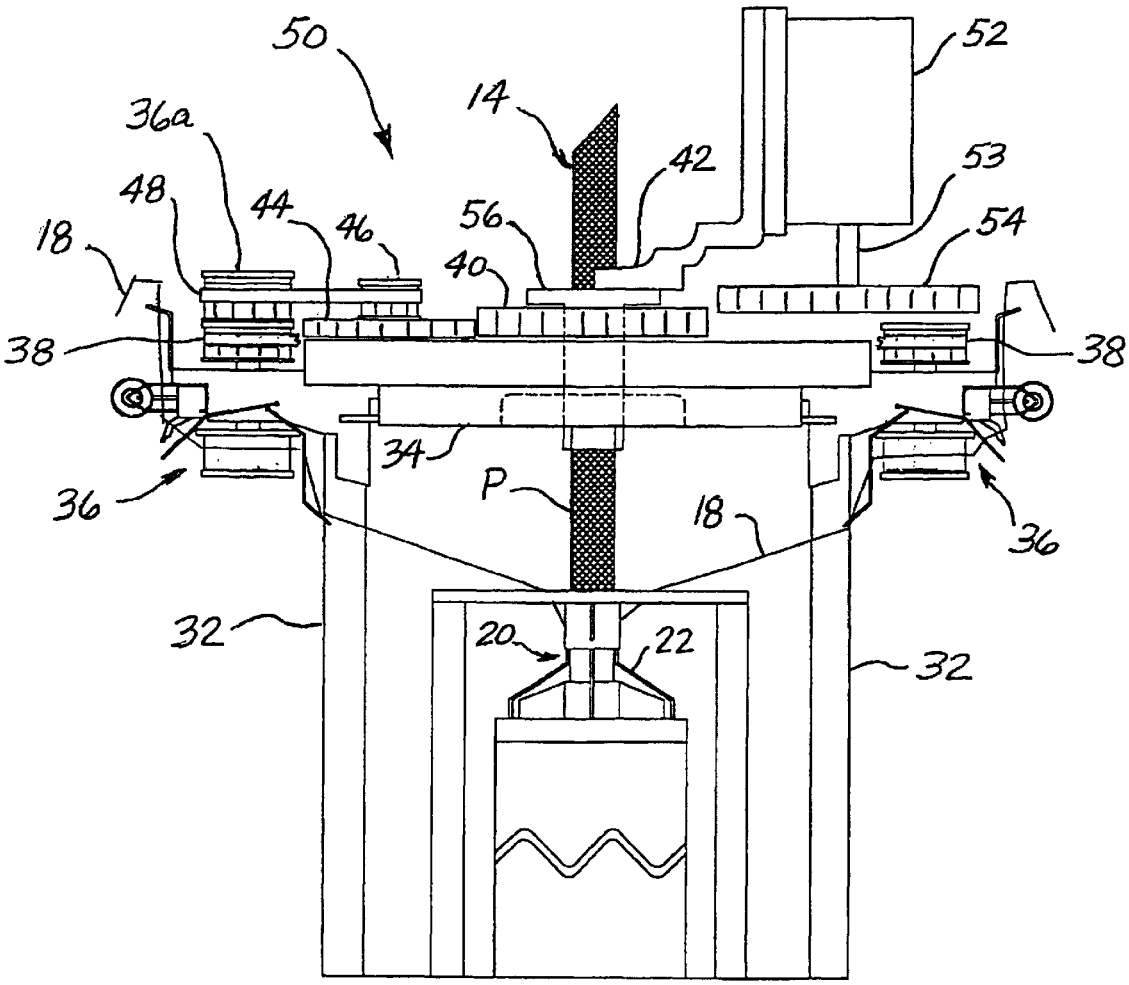
FIG. 5 is a schematic illustration of a modified version of the yarn feeding system of the present invention.

Referring now to FIG. 5, a modified version of the present yarn feeding system, particularly intended to supplement the aforedescribed feeder head assembly 30, is presented. In this modified version of the feeder head assembly, generally designated 50, a variable speed motor unit 52 is further provided and mounted within the knitter machine 10 atop the support plate 34 in juxtaposition to the support bracket 42. An associated gear member 54 operatively coupled to the motor unit 52 via a drive shaft 53 is sized in its diameter and perimeter teeth and positioned at a level to engage the central gear 40, which, in this version of feeder head assembly 50, is preferably increased in thickness to accommodate engagement with motor gear 54 about the top of the central gear structure while maintaining engagement with the planetary gear 44 about the bottom of the central gear structure. The central gear 40 in this version is further modified in its mounting relative to the support plate 34 so that it is rotatable therein and not stationary as in the aforedescribed feeder head assembly 30. In this regard, a spindle 56 is axially mounted through the central gear 40 and rotatably coupled thereto via a central bearing fitted within the gear. The spindle 56 is further disposed axially through the support plate 34 and adapted to rotate therein via a similar bearing member fitted within the support plate. The top of spindle 56 is secured to the support bracket 42 so that the spindle is made stationary within the knitting machine 10 along the central axis thereof and the support plate 34 and central gear 40 may rotate relative to the spindle. As a result, the central gear 40 in the modified feeder head assembly 50 may be rotated in either direction driven by the variable speed motor unit 52 acting through gear member 54 and thereby vary the rotational speed of the central gear in either a positive or negative fashion. This added feature of rotational adjustment of the central gear 40 serves to provide a fine adjustment to the rate control of the yarn feeder units 36 imparted through the respective planetary and control gears, 44 and 46, and would be used to increase or decrease the yarn fed into the knitter head 20 and its reciprocating knitting needles 22 for greater control of the tensioning of the yarn and the knitted pattern P applied to the reinforced hose product 14.

Therefore, it is apparent that the described invention provides an improved positive yarn feeding device and associated method for use in the production of reinforced flexible hose. More particularly, the present invention provides a positive yarn feeding system that delivers multiple strands of yarn to the knitter head of a conventional circular knitting machine at a controlled and synchronized rate and in a manner more economical and efficient than heretofore devised. Furthermore, the described invention provides an improvement to positive yarn feeding for the industrial production of reinforced flexible hose that is reliable in its operation so as to reduce downtimes and defects in the production process. In addition, the present yarn feeding system for knitted reinforcement of flexible hose serves to enhance the quality of the final reinforced hose product and afford greater control of the knitted pattern applied during production. The described positive yarn feeding system is also easily assembled and readily adapted to the knitter heads of conventional circular knitting machines that are used in industry for flexible hose reinforcement.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Accordingly, it is understood that this invention is not limited to the particular embodiment described, but rather is intended to cover modifications within the spirit and scope of the present invention as expressed in the appended claims.

What is claimed:

1. A system for feeding yarn in a circular knitter machine of the type used to reinforce a flexible hose by applying a knitted yarn pattern upon the exterior of the hose moving axially through the machine, the knitter machine being further of the type including a cylindrical knitter head disposed along the central axis of the machine and a deck rotatable about the axis, the knitter head further containing a plurality of knitting needles disposed about the knitter head, each needle operatively connected to a rotatable cam member and thereupon made to reciprocate along the central axis and thereby apply the knitted yarn pattern, comprising:

a plurality of wound supplies of yarn in continuous strands mounted upon the deck for rotation about the central axis of the machine;

feeder head means assembled to rotate about the knitter head and connected to receive respective strands from said plurality of wound supplies of yarn for positively feeding the strands into the knitter head and the reciprocating needles thereof at a controlled and synchronized rate; and motor means connected to drive the rotation of said feeder head means in unison with the deck and cam member of the knitter machine.

2. A yarn feeding system according to claim 1, wherein said feeder head means comprises:

positive feeder means mounted for rotation about the central axis of the knitter machine and operatively connected to draw respective strands of yarn from the plurality of wound supplies for positively feeding the yarn strands into the knitter head and to the reciprocating knitting needles; and rate control means operatively connected to said positive feeder means for controlling the feed rate of the yarn strands to the knitting needles.

3. A yarn feeding system according to claim 2, wherein said positive feeder means comprises:

a support plate having a central opening axially therethrough and rotatably mounted about the central axis of the knitting machine;

a plurality of positive feeder units rotatably mounted to said support plate about the periphery thereof, each of said plurality of positive feeder units being operatively connected to receive a yarn strand from a respective one of said wound supplies of yarn; and a first belt member interconnecting said plurality of positive feeder units for concurrent rotation thereof.

4. A yarn feeding system according to claim 3, wherein said rate control means comprises:

a first gear member stationed within the knitting machine in a coaxial position relative to said support plate;

a second gear member rotatably mounted to said support plate and positioned to engage said first gear member so that said second gear member rotates about said first gear member as said support plate rotates;

a third gear member having a selected size and number of gear teeth, said third gear member being coaxially positioned and mounted upon said second gear member so as to rotate coaxially together with said second gear member; and a second belt member engaged between said third gear member and a selected one of said positive feeder units for rotation thereof at a controlled rotational rate determined by the size and teeth of said third gear member.

5. A yarn feeding system according to claim 4, wherein said plurality of wound supplies of yarn are yarn spools.

6. A yarn feeding system according to claim 5, wherein said motor means is a drive motor mounted within the knitting machine.

7. A yarn feeding system according to claim 1, wherein said feeder head means comprises:

positive feeder means mounted for rotation about the central axis of the knitter machine and operatively connected to draw respective strands of yarn from the plurality of wound supplies for positively feeding the yarn strands into the knitter head and to the reciprocating knitting needles; and variable rate control means operatively connected to said positive feeder means to provide a fine adjustment to the rate control of said positive feeder means and thereby reduce the tensioning of the yarn strands delivered to the knitting needles.

8. A yarn feeding system according to claim 7, wherein said positive feeder means comprises:

a support plate having a central opening axially therethrough and rotatably mounted about the central axis of the knitting machine;

a plurality of positive feeder units rotatably mounted to said support plate about the periphery thereof, each of said plurality of positive feeder units being operatively connected to receive a yarn strand from a respective one of said wound supplies of yarn; and a first belt member interconnecting said plurality of positive feeder units for concurrent rotation thereof.

9. A yarn feeding system according to claim 8, wherein said variable rate control means comprises:

a first gear member rotatably coupled to said support plate for independent rotation about the central axis of the knitting machine;

variable speed drive means mounted within the knitter machine for rotating said first gear member at an adjusted rate in either direction relative to said support plate;

a second gear member rotatably mounted upon said support plate and positioned to engage said first gear member so that the rate of rotation of said second gear member is established by the adjusted rate of said first gear member;

a third gear member having a selected size and number of gear teeth, said third gear member being coaxially positioned and mounted upon said second gear member so as to rotate coaxially together with said second gear member; and a second belt member engaged between said third gear member and a selected one of said positive feeder units for rotation thereof at variably controlled rotational rate determined by the size and teeth of said third gear member.

10. A yarn feeding system according to claim 9, wherein said variable speed drive means comprises:

a variable speed motor stationed to the knitting machine; and a fourth gear member operatively coupled to said variable speed motor and disposed for rotational engagement with said first gear member.

11. A yarn feeding system according to claim 10, wherein said plurality of wound supplies of yarn are yarn spools.

12. A yarn feeding system according to claim 11, wherein said motor means is a drive motor mounted within the knitting machine.

* * * * *